United States Patent [19]

Rothwell et al.

[11] Patent Number: 4,540,373

[45] Date of Patent: Sep. 10, 1985

[54] METHOD OF FABRICATING AN ARC TUBE FOR AN ARC DISCHARGE LAMP

[75] Inventors: Harold L. Rothwell, Rowley; George J. English, Reading, both of Mass.

[73] Assignee: GTE Products Corporation, Stamford, Conn.

[21] Appl. No.: 645,649

[22] Filed: Aug. 30, 1984

[51] Int. Cl.[3] ..... H01J 9/32

[52] U.S. Cl. ..... 445/22; 65/110; 445/43

[58] Field of Search ..... 228/60; 445/22, 26, 445/27, 43; 65/34, 110

[56] References Cited

U.S. PATENT DOCUMENTS

| | | | |
|---|---|---|---|
| 3,305,289 | 2/1967 | Fridrich | 445/26 X |
| 3,305,747 | 2/1967 | Feinstein | 445/22 X |
| 3,419,947 | 1/1969 | Gottschalk et al. | 445/26 |
| 3,685,880 | 8/1972 | Sobieski | 445/26 |

FOREIGN PATENT DOCUMENTS

| | | | |
|---|---|---|---|
| 159541 | 12/1980 | Japan | 445/26 |

*Primary Examiner*—Kenneth J. Ramsey

*Attorney, Agent, or Firm*—Joseph S. Romanow

[57] ABSTRACT

This invention provides an improved method of fabricating an arc tube, particularly a miniaturized arc tube having precise geometry and requiring exact electrode alignment. The improved method divides the press sealing operation into two distinct steps. In the first or preforming step, the ends of the arc tube are heated and preformed such that the ends have a substantially elliptical cross section; in the second or pressing step, the preformed ends are heated and pressed together to form completed press seals. During each step, the viscosity of the pliable glass remains low so that internal shearing forces are substantially reduced from those experienced in the prior art methods. As a result of the low viscosity during the pressing step, electrode misalignment, tearing of molybdenum foils, and deformation of the midsection of the arc tube are virtually eliminated. An electrode and a starting probe may be inserted with ease into a preformed end because of its flattened cross section. In the absence of the preforming step, a tubular blank having a larger internal diameter might be required thereby necessitating a more bulky arc tube and greater glass consumption.

6 Claims, 9 Drawing Figures

METHOD OF FABRICATING AN ARC TUBE FOR AN ARC DISCHARGE LAMP

CROSS REFERENCES TO RELATED APPLICATIONS

Copending U.S. application Ser. No. 645,659 by Rothwell et al., filed concurrently herewith and assigned to the assignee of this application, contains related subject matter.

TECHNICAL FIELD

This invention relates to the field of fabricating arc tubes for arc discharge lamps.

BACKGROUND ART

Arc tubes typically are fabricated from tubular blanks. A quartz cylinder having an outer diameter of eight millimeters and a wall thickness of two millimeters is an example of such a blank. The bulbous midsection of the arc tube is formed in a portion of the blank, e.g., by means of a carbon die mold. During this step, the portions of the blank adjoining the midsection on both sides are not formed and retain their initial tubular shape. Electrode means are inserted into both ends of the blank such that the electrodes protrude into the interior of the midsection of the arc tube. Press seals are formed in the portions of the blank adjoining the midsection. In this step, the electrode means are fused within each press seal. An electric arc generating and sustaining fill is introduced into the interior of the bulbous midsection after which the midsection is hermetically sealed.

While this method generally has served the industry well, certain problems have arisen particularly in the manufacture of low-wattage miniature arc tubes where more precise manufacturing techniques are required. During the formation of the press seals, the opposed walls of the tubular blank are rapidly compressed and pinched together. The lateral flow of glass during the press operation may cause electrode misalignment or tearing of the molybdenum foil disposed in the press seal. The formation of the press seals may also deform the bulbous midsection; in a miniaturized lamp having precise arc tube geometry, such deformation may significantly detract from the operating characteristics of the arc tube.

It would constitute an advancement of the art if there were disclosed an improved method of fabricating an arc tube which would facilitate the manufacture of precision low-wattage miniaturized arc tubes.

DISCLOSURE OF THE INVENTION

It is, therefore, an object of the invention to obviate the deficiencies in the prior art.

It is another object of the invention to provide an improved method of fabricating an arc tube wherein precise electrode alignment may be maintained during the formation of the press seals.

It is a further object of the invention to provide a method of fabricating an arc tube which requires a minimal quantity of glass with respect to the size of the electrode means.

It is still another object of the invention to provide an improved method of fabricating an arc tube which eliminates tearing of molybdenum foils during the formation of the press seals.

It is still a further object of the invention to provide an improved method of fabricating an arc tube which enables more precise arc tube geometry in low-wattage miniaturized lamps.

These objects are accomplished, in one aspect of the invention, by the provision of a method of fabricating an arc tube from a tubular blank. The blank has a circular cross section. The arc tube has an elongated body, a bulbous midsection hermetically enclosing an interior, and two opposed ends adjacent to the midsection. Each of the ends has a press seal formed in it and electrode means mounted in the press seal. The electrode means protrudes into the interior. The interior contains an electric arc generating and sustaining fill.

The method of fabricating the aforementioned arc tube disclosed herein comprises the steps of heating the blank to pliability, forming the bulbous midsection in a portion of the blank, and preforming the ends in portions of the blank adjacent to the midsection, each of the preformed ends having a substantially elliptical cross section; inserting electrode means into each of the preformed ends such that the electrode means protrudes into the interior; then heating the preformed ends to pliability and forming press seals in each of the preformed ends thereby mounting the electrode means in each of the press seals; and then filling the interior with the fill and thereafter hermetically sealing the midsection.

Arc tubes constructed in accordance with this method avoid the manufacturing defects encountered in the prior art.

BEST MODE FOR CARRYING OUT THE INVENTION

For a better understanding of the present invention together with other and further objects, advantages, and capabilities thereof, reference is made to the following disclosure and appended claims taken in connection with the above-described drawings.

Figure 1:
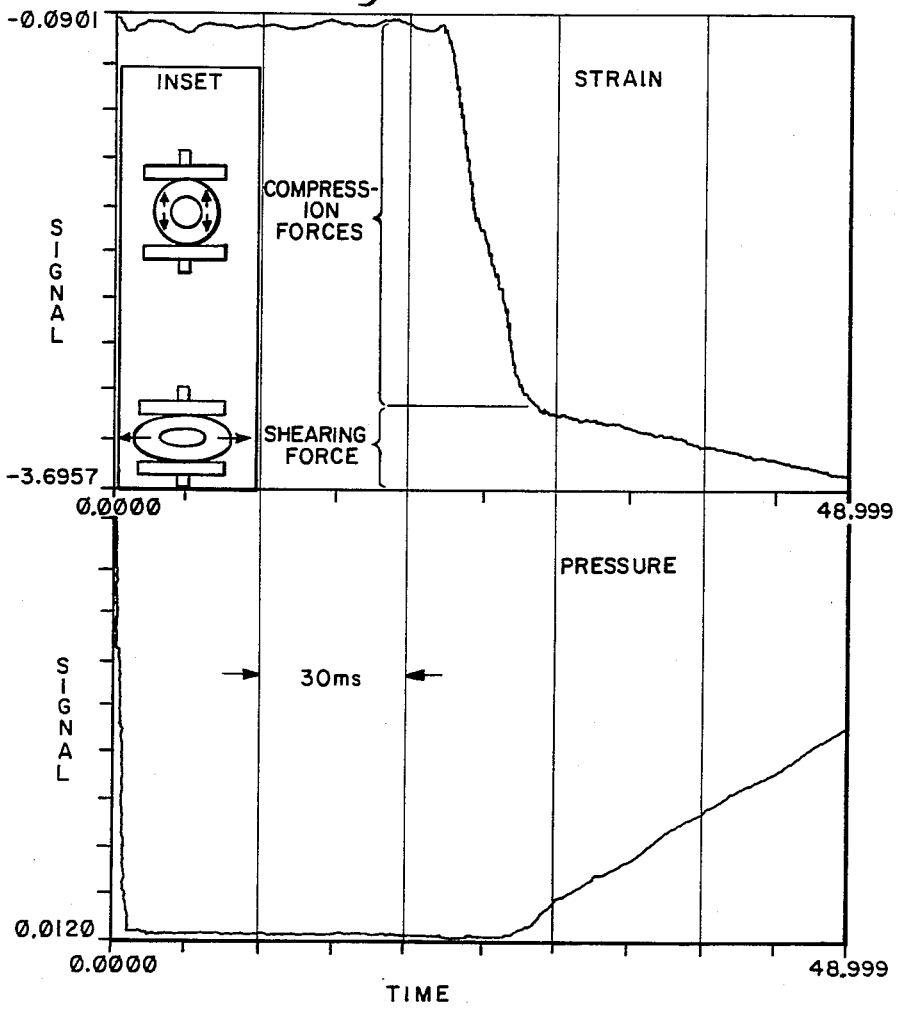
FIG. 1 contains plots of strain and pressure parameters associated with a pressing operation on a tubular quartz blank; the inset relates the plots to stages of deformation of the tubular blank.

FIG. 1 shows plots of pressure and strain parameters as a function of time during the pressing of a quartz arc tube. These plots demonstrate the single-step pressing process typically employed in the prior art. Implicit in the plots is another important parameter, temperature. As time proceeds from the beginning of the press operation, the temperature of the quartz decreases rapidly. The inset in the drawing relates the plots pictorially to stages of deformation of the quartz tube during the pressing step. It may be noted from these plots that pressure increases substantially during the latter part of the press operation. The lateral or outward flow of glass in the press seal region, which causes internal shearing forces, likewise occurs during the latter part of the press operation. These shearing forces may cause manufacturing defects, such as electrode misalignment, tearing of the molybdenum foil disposed within the press seal, and/or deformation of the shape of the bulbous midsection of the arc tube. FIG. 1 indicates that the manufacturing defects encountered in the prior art occur during the latter stage of the press operation during the period when the quartz has cooled considerably and the viscosity has increased.

The invention disclosed herein divides the fabrication of the press seal into two distinct steps. In the first step, called the preforming step, the tubular glass blank initially having a circular cross section is heated to pliability and then formed such that the cross section of the blank in the press seal region is substantially elliptical. In the second or pressing step which occurs after insertion of the electrode means, the preformed blank is again heated to pliability and then pressed to form a press seal.

During execution of each step and particularly during the pressing step, the pliable glass has low viscosity so that internal shearing forces are minimized. The intermediate heating of the preformed region causes the pliable glass to collapse onto the electrode means, so that the volume of glass moved by the press feet during the pressing operation also is minimized.

Figure 2:
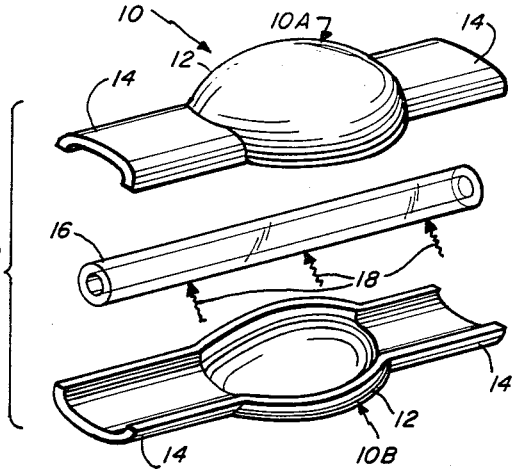
FIG. 2 is a pictorial illustrating the die mold used in forming the bulbous midsection and preforming the press-seal regions in an embodiment of the invention.

FIG. 2 shows die mold 10 comprising mold parts 10A and 10B for forming the bulbous midsection of an arc tube. Die mold 10 also comprises preformed end mold parts 14. In a preferred embodiment of the invention, the bulbous midsection and the preformed ends are formed concurrently. Wavy arrows 18 signify the application of heat to tubular blank 16 prior to the molding step. Blank 16 is a straight section of tube having a circular cross section. Die mold 10 is designed such that the midsection and the press seal region merge smoothly into the preferred shape so that there will be minimal deformation of the midsection during the pressing operation.

In practice, a relatively long length of glass tubing is mounted in a lathe. One end of the tube is sealed. A cylindrical clam-shell burner may be used for heating the glass. Once tubular blank 16 has been suitably heated, die mold 10 is disposed about the blank and a surge of gas is driven into the tube from the non-sealed end causing the tube to expand into the die mold. The glass tube is usually rotated during the heating step and is maintained fixed in position during the preforming step.

Figure 3:
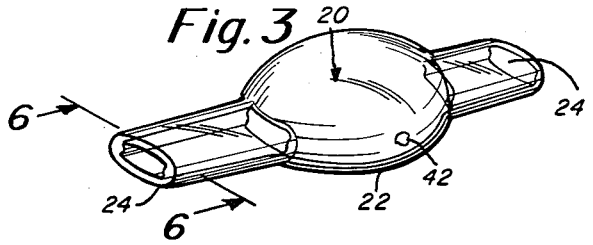
FIG. 3 is a pictorial illustrating the preformed arc tube having a formed bulbous midsection and preformed ends on both sides of the midsection.

Blank 16 may be heated and molded in sections thus forming a series of preformed arc tubes along the length of the blank. Individual arc tubes with preformed ends may be obtained by making saw cuts on the flattened press seal ends. The preformed arc tubes are ready for cleaning, insertion of electrode means, and for the subsequent press seal operation. FIG. 3 shows preformed arc tube 20 having a formed midsection 22 with preformed press seal regions 24 at both ends adjacent to midsection 22.

Figure 4A:
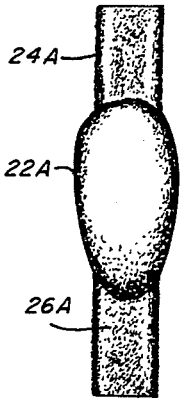
FIGS. 4A and 4B are front X-ray views of preformed arc tubes having substantially tear-shaped and ellipsoidal midsections, respectively.
Figure 4B:
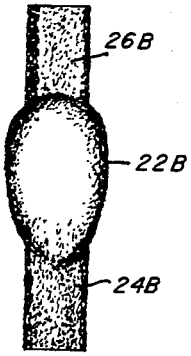
Figure 5A:
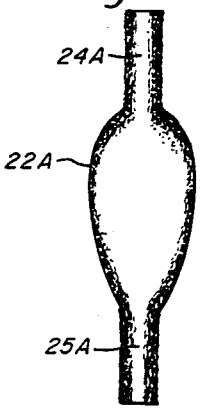
FIGS. 5A and 5B are side X-ray views of preformed arc tubes having substantially tear-shaped and ellipsoidal midsections, respectively.
Figure 5B:
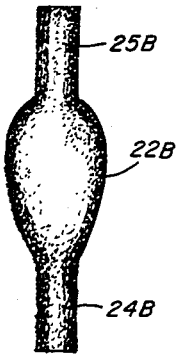

FIGS. 4A and 4B are front X-ray views of preformed arc tubes. In FIG. 4A, midsection 22A is tear-shaped; FIG. 4B shows a second preformed arc tube having an ellipsoidal shaped midsection 22B. The front views show the flattened surfaces of the preformed ends in elevational views. FIGS. 5A and 5B are side X-ray views of the preformed arc tubes of FIGS. 4A and 4B, respectively.

Figure 6:
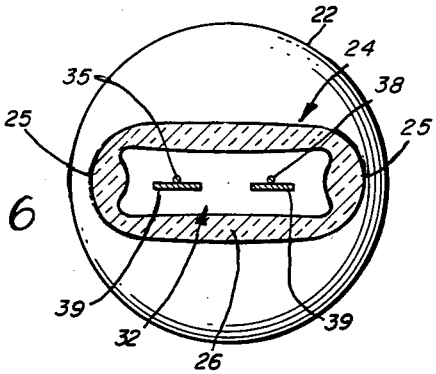
FIG. 6 is a cross-sectional view taken along line 6—6 of FIG. 3 showing the substantially ellipsoidal cross section of the press-seal region in its preformed state and the electrode means.

FIG. 6 is a cross-sectional view of preformed end 24 taken along line 6—6 of FIG. 3. As shown in the drawing, the cross section is substantially elliptical in shape having a horizontal major axis and a vertical minor axis with the horizontal axis being parallel to the flattened surface of the preformed end. The cross section shows molybdenum foils 39 disposed in a horizontal plane. Starting electrode 35 and electrode 38 also are shown in cross section. Interior 32 of end 24 has a substantially elliptical cross section except for an accumulation of glass at curved sides 25 formed during the molding process. Preferably, die mold 10 has been designed so that the minor axis of interior 32 is as small as possible yet sufficient to permit facile insertion of electrodes 35 and 38 together with foils 39. In this way, the movement of glass during the subsequent press operation will be minimized.

FIG. 6 illustrates an additional advantage of the invention, particularly in the fabrication of miniaturized arc tubes. Electrode means, which at one end may include starting probe 35, electrode 38, and molybdenum foils 39, may be inserted with ease into preformed end 24 because the horizontal major axis of interior 32 is extended with respect to the internal diameter of tubular blank 16. In the absence of the preforming step, a tubular blank with a larger internal diameter might be required to accommodate the same electrode means thereby necessitating a more bulky arc tube and greater glass consumption.

The build-up of glass on curved sides 25 during the preforming step does not cause a problem in the intermediate heating stage. Use of a cylindrical clam-shell burner with a proper burner diameter insures that sides 25 may be positioned with respect to the flame cones such that the entire body of preformed end 14 will be heated uniformly to the pliability state. In practice, the choice of burner diameter was not critical; a burner having a slightly larger diameter then would be used with a cylindrical blank of comparable dimensions performed well.

Figure 7:
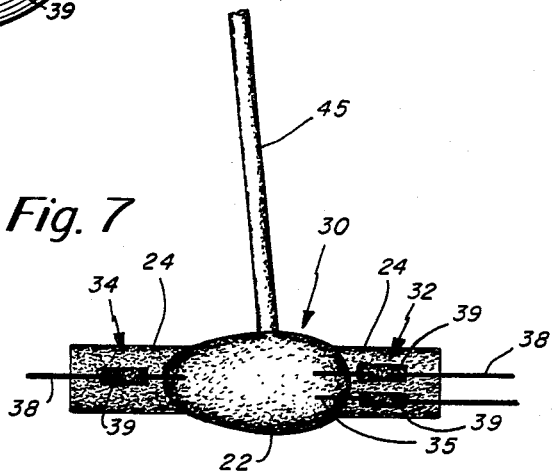
FIG. 7 is a pictorial illustrating an arc tube after formation of the press seals; the pictorial shows the molybdenum-foil strips in position, the aligned electrodes, the press-seal regions pressed into their final forms, and the fill tubulation.

FIG. 7 shows the arc tube after the press seals have been completely formed with the electrode means properly aligned and permanently mounted within the press seals. In FIG. 3, there is preferably provided by virtue of the mold configuration, a small nipple 42 on bulbous midsection 22. This represents a reference point for attachment of small-diameter glass tube 45, illustrated in FIG. 7. Tube 45 is used for fill purposes. A fill substance, such as a globule of mercury, may be inserted through tube 45 into the interior of bulbous midsection 22. Midsection 22 may then be evacuated by way of the tube 45 and an inert gas, such as nitrogen, may be introduced into the envelope by way of the tube. Thereafter, midsection 22 may be sealed by a torch, or the like, after which tube 45 is removed leaving the finished arc tube.

Arc tubes fabricated in accordance with the invention have been used in constructing examples of 175 watt Sylvania Energy Saver lamps. No torn molybdenum foil strips and no press seal leakages have been observed. In testing these examples, the same procedures were used as in conventional testing operations. These procedures include tests relating to burner adjustments, press feet dwell, and nitrogen flow rates. Several of the examples have been on life tests and have shown no unfavorable signs associated with the pressing operation.

In these examples, quartz tubular blanks were employed with an internal diameter of four millimeters and a wall thickness of two millimeters. The preformed ends had an internal minor axis of two millimeters and internal major axes ranging from nine to twelve millimeters. These dimensions permitted easy insertion of the electrode means after the preforming step. The extension of the internal tube diameter of the blank to the internal major axis of the preformed end permitted facile insertion of an electrode and starting probe that would not have been possible without the preforming step.

Copending patent application by Rothwell et al, U.S. Pat. No. 645,659, filed concurrently herewith and assigned to the assignee hereof, discloses a novel arc tube design employing precise arc tube geometry and precise electrode placement within the arc tube envelope. The entire contents of this application are incorporated herein by reference. The specially shaped arc tube has an elongated body with press seals in the opposed ends, a hemispherical top with radius $R_1$, a hemispherical bottom with radius $R_2$, and a middle section being a frustrum of a right circular cone which on one end mates with the top and on the other end mates with the bottom so that the arc tube has a smooth and continuous body. The ratio, $R_1/R_2$, is always greater than one, and in preferred embodiments $R_1/R_2$ is within the range of 1.5 to 3, inclusive. Precise insertion depths and alignment of the electrodes are required in order to obtain the improved operational characteristics of this arc tube.

Examples of this arc tube were constructed in accordance with the instant invention with exemplary results. In addition to precise fabrication of the arc tube, it is believed that the instant invention contributes to the arc tube's improved operating characteristics by minimizing the re-entry and void zones in the interior of the arc tube. There is reduced heat loss at the ends of the arc tube because of the reduced quantity of glass in the starting electrode press-seal region. There is a reduction in gas instability and turbulence within the end portions resulting in better convection flow within the arc tube. The invention enables fabrication of smoother transitions between the midsection and the press-seal regions of the arc tube.

While there have been shown what are at present considered to be preferred embodiments of the invention, it will be apparent to those skilled in the art that various changes and modifications may be made herein without departing from the scope of the invention as defined by the appended claims.

We claim:

1. A method of fabricating an arc tube from a tubular blank, said blank having a circular cross section, said arc tube having an elongated body, a bulbous midsection hermetically enclosing an interior, and two opposed ends adjacent to said midsection, each of said ends having a press seal formed therein and electrode means mounted in said press seal, said electrode means protruding into said interior, and an electric arc generating and sustaining fill within said interior, said method comprising the steps of:

(a) heating said blank to pliability, forming said bulbous midsection in a portion of said blank, and preforming said ends in portions of said blank adjacent to said midsection, each of said preformed ends having a substantially elliptical cross section; then (b) inserting said electrode means into each of said preformed ends such that said electrode means protrudes into said interior; then (c) heating said preformed ends to pliability and forming press seals in each of said preformed ends thereby mounting said electrode means in each of said press seals; and then (d) filling said interior with said fill and thereafter hermetically sealing said midsection.

2. A method as described in claim 1 wherein each of said preformed ends has an essentially elliptical cross section having an internal minor axis which is as small as possible yet sufficient to permit facile insertion of said electrode means.

3. A method as described in claim 2 wherein the internal diameter of said tubular blank is insufficient to permit insertion of said electrode means and the internal major diameter of said elliptical cross section is sufficient to permit facile insertion of said electrode means.

4. A method as described in claim 2 wherein said bulbous midsection is substantially tear-shaped, said tear-shaped midsection comprising a first region adjoining one of said ends, a second region adjoining the other of said ends, and a third region intermediate said first and second regions, said first region being substantially hemispherical in shape with radius $R_1$, said second region being substantially hemispherical in shape with radius $R_2$, said third region being substantially a frustrum of a right circular cone wherein the ratio, $R_1/R_2$, is greater than 1.

5. A method as described in claim 2 wherein said bulbous midsection is substantially ellipsoidal in shape.

6. A method as described in claim 2 wherein said bulbous midsection is substantially spherical in shape.

* * * * *